United States Patent [19]

Sandt

[11] Patent Number: 4,940,139

[45] Date of Patent: Jul. 10, 1990

[54] MOP HEAD CONTAINER

[76] Inventor: Jean Sandt, 402 King St., E. Stroudsburg, Pa. 18301

[21] Appl. No.: 422,521

[22] Filed: Oct. 17, 1989

[51] Int. Cl.[5] ..... A45D 44/18

[52] U.S. Cl. ..... 206/362.2; 206/204; 206/209; 206/362.3

[58] Field of Search ..... 206/361, 362.1, 362.2, 206/362.3, 15.2, 15.3, 204, 209

[56] References Cited

U.S. PATENT DOCUMENTS

| | | | |
|---|---|---|---|
| 615,357 | 12/1898 | Johnson et al. | 206/362.3 |
| 795,768 | 7/1905 | Hoerichs | 206/209 |
| 3,127,985 | 4/1964 | Scott | 206/362.3 |
| 3,361,507 | 1/1968 | O'Neil . | |
| 3,741,378 | 6/1973 | Parker | 206/361 X |
| 3,746,162 | 7/1973 | Bridges | 206/361 |
| 4,211,750 | 7/1980 | Gillespie | 206/361 X |
| 4,638,910 | 1/1987 | Bokmiller | 206/361 X |

FOREIGN PATENT DOCUMENTS

| | | | |
|---|---|---|---|
| 734794 | 5/1966 | Canada | 206/361 |
| 1009078 | 2/1952 | France | 206/361 |

*Primary Examiner*—William Price

*Attorney, Agent, or Firm*—Terry M. Gernstein

[57] ABSTRACT

A mop head container has a bottom portion that is hingeably connected to a top portion. The container has a curved bottom and projections mounted on the top that squeeze the mop head against the curved bottom to force liquid out of the mop head. The container also includes curved troughs that receive the liquid from the curved bottom and conduct such liquid to drain holes which are fluidically connected to a collection chamber. Dessicant and deodorant are located in the collection chamber and a door on that chamber provide access thereto.

5 Claims, 2 Drawing Sheets

MOP HEAD CONTAINER

TECHNICAL FIELD OF THE INVENTION

The present invention relates to the general art of containers, and to the particular field of cleaning implement containers.

BACKGROUND OF THE INVENTION

Many household jobs require a mop or other such brush-like cleaning implement. These jobs often further require such implement to be immersed in water, to place cleaning solution thereon, to execute the cleaning operation or to rinse the brush after use.

This procedure may require the implement to be wet when it is ready for storage. Thus, the art has included several cleaning implement containers which are intended to store wet or damp brushes, see for example, the container disclosed in U.S. Pat. No. 4,638,910.

However, due to the use made of the brush, storage in a damp or wet condition may cause odors or even a build-up of germs on the stored brush. Both of these conditions are undesirable. While the art also includes brush holders which include deodorant, these devices still do not address the problem of germs or bacteria which can grow on a damp or wet brush head during storage. By merely including deodorants, such devices really treat the symptom of the problem rather than the problem itself.

Accordingly, there is a need for a brush or mop head container which dries, deodorizes and disinfects the brush or mop head stored therein as well as stores and contains that head.

OBJECTS OF THE INVENTION

It is a main object of the present invention to provide a brush or mop head container.

It is another object of the present invention to provide a brush or mop head container and which dries, deodorizes and disinfects the brush or mop head stored therein as well as stores and contains that head.

SUMMARY OF THE INVENTION

These, and other, objects are achieved by a mop head container that includes projections on the top of a case that engage the mop head when that case is closed by the top and gently squeeze that mop head against the bottom of the case. The bottom is curved to be convex with respect to the top and a drainage trough is defined about that curved bottom to receive the liquid squeezed out of the mop head. A fluid catching compartment is located beneath the curved bottom and is in fluid communication with the trough via drain holes defined through the bottom. Desiccant and germicidal materials are placed in the catching compartment and any fluid draining into such compartment will be dried and disinfected. Deodorant materials are placed in the catching container and in the case.

In this manner, the container will not only store the mop head, it will contribute to the rapid drying of that head as well as to the deodorizing, drying, and disinfecting of the fluid associated with the head.

BRIEF DESCRIPTION OF THE DRAWING FIGURES

DETAILED DESCRIPTION OF THE PREFERRED EMBODIMENT OF THE INVENTION

Figure 1:
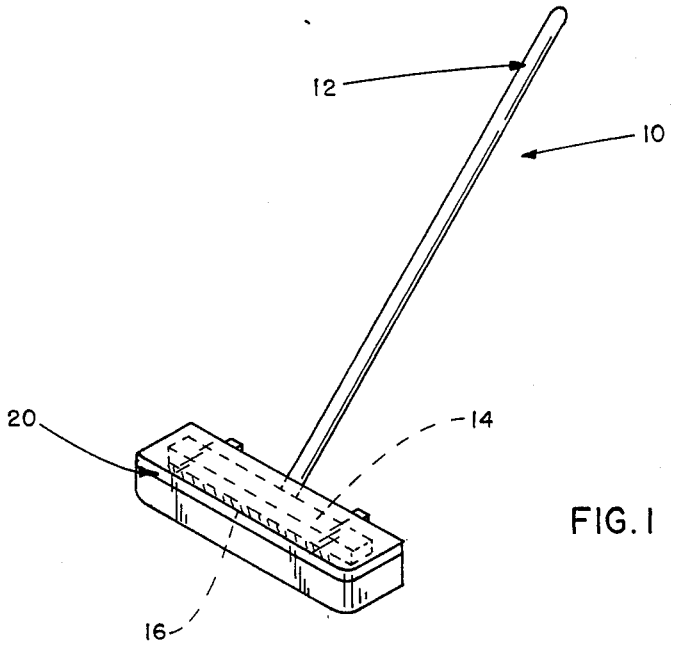
FIG. 1 is a perspective view of a brush-like cleaning implement in conjunction with the container of the present invention.

Shown in FIG. 1 is a brush-like cleaning implement, such as a mop 10 having a handle 12 and a head 14 on which a plurality of bristles or sponge-like material 16 is mounted. The mop head is stored in a container 20 between uses.

As discussed above, the mop 10 is often used in jobs that require the mop head to be wet when it is stored between uses. This damp condition can create odors, or generate germs that are undesirable. Accordingly, the container 20 assists in the drying, disinfecting and deodorizing of the mop head during storage.

Figure 2:
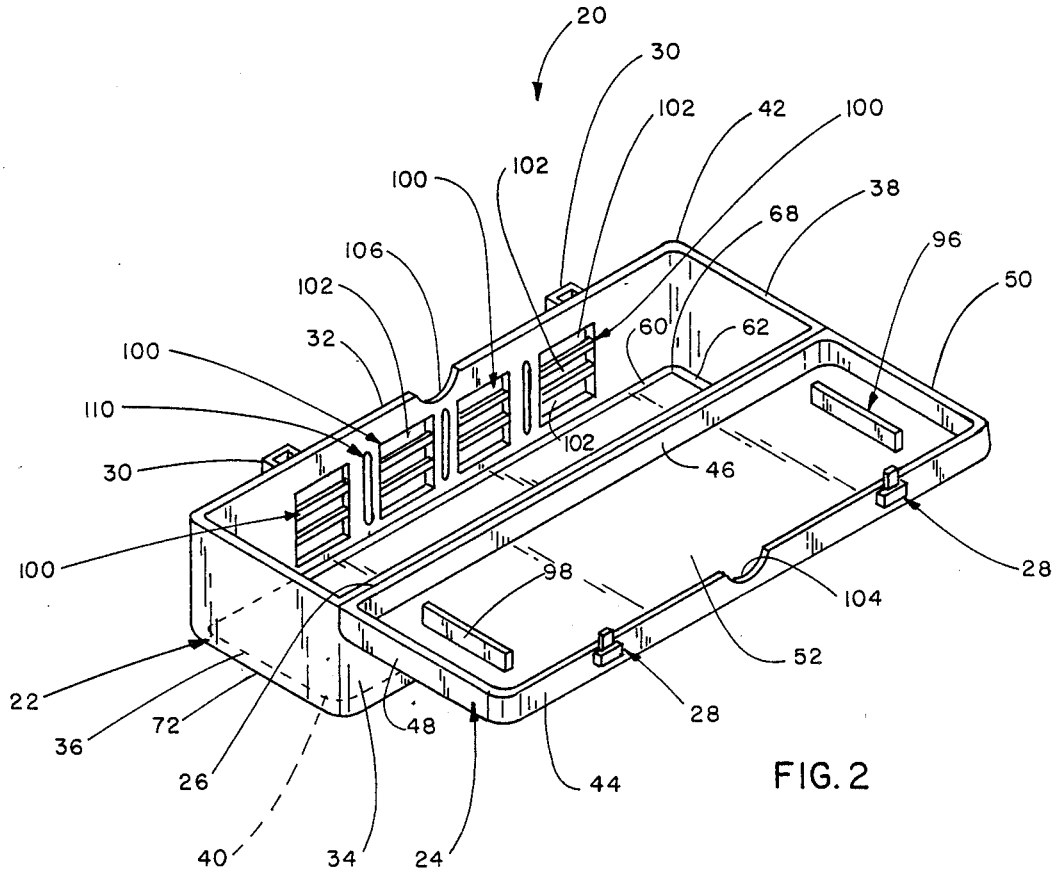
FIG. 2 is a perspective view of the container of the present invention in the open configuration.
Figure 4:
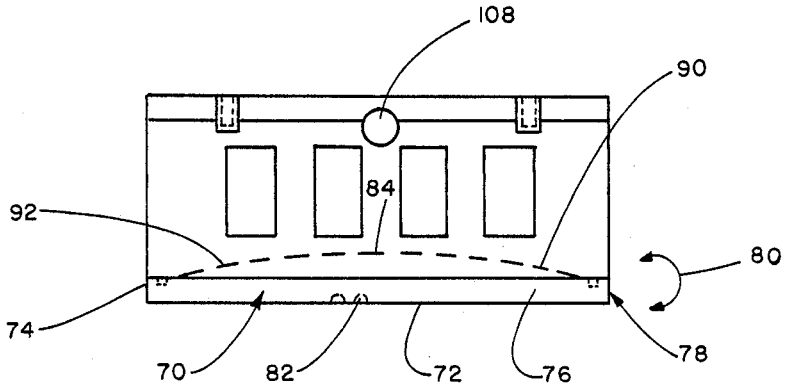
FIG. 4 is a side elevational view of the container.
Figure 5:
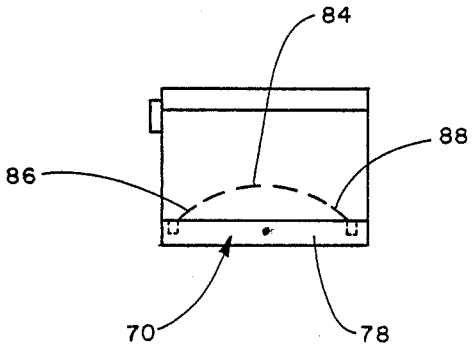
FIG. 5 is an end elevational view of the container.

The container 20 is shown in FIG. 2 in an open configuration, and includes a bottom portion 22 and a top portion 24 that is hingedly mounted on that bottom portion by a hinge 26 to move from the FIG. 2 open condition to the FIG. 4 closed condition. The top portion is locked to the bottom portion by locks 28 on the top that co-operate with keepers 30 on the bottom.

The bottom portion includes first and second side walls 32 and 34, first and second end walls 36 and 38, and a bottom 40 that is connected to those walls to form a receptacle into which the mop head is received. The bottom portion is rectangular to have corners, such as corner 42 defined at the intersection of the sides and ends.

The top portion includes front and rear side walls 44 and 46, and end walls 48 and 50 which are all connected together by a top 52 with the hinge 26 being on the rear side wall and the locks 28 being on the front side wall. The top portion is sized and shaped to correspond to the bottom portion to close that bottom portion when the top is juxtaposed onto the bottom portion as shown in FIG. 4.

The container includes a drainage system that removes fluid from the vicinity of the mop head in a manner that contributes to the drying of that mop head while it is in the container. The drainage system functions to squeeze fluid out of the mop head and to remove that fluid from the vicinity of the mop head and into a location that dries, disinfects and deodorizes such fluid. The mop head is thus stored in a dry, clean and odorless condition.

Figure 3:
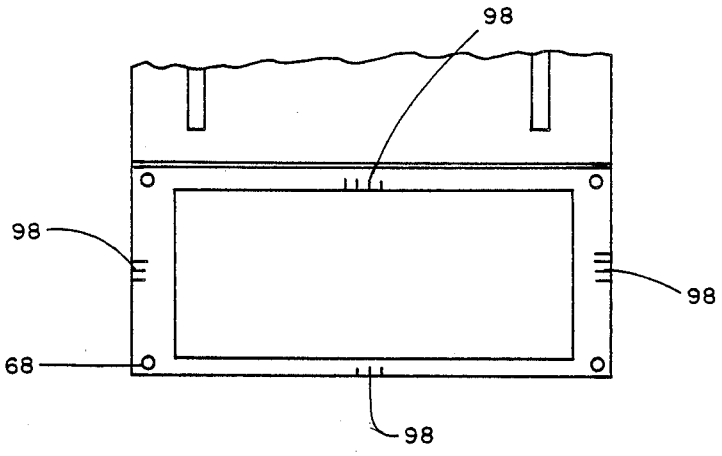
FIG. 3 is a top plan view of the open container.

The drainage system includes a two side troughs, such as trough 60 defined in the bottom 40 to be located adjacent to the side walls 32 and 34 and to extend from the end wall 36 to the end wall 38 and two end troughs, such as end trough 62 defined in the bottom to be located adjacent to the end walls 36 and 38 and to extend from side wall 32 to side wall 34. The trough system thus circumnavigates the bottom and is shown in FIG. 3 to be of rectangular shape to have corners, such as corner 66 located coincidentally with the corners of the bottom portion. A drain hole, such as drain hole 68, is located in each corner of the trough system and fluidically connect the inside of the bottom portion with the outside of the bottom. A fluid catching compartment 70 is located beneath the bottom 40 and is placed in fluid communication with the bottom portion inside volume by the drains 68. The fluid catching compartment includes a bottom wall 72 which extends beneath and spaced from the bottom wall 40 and is connected to end walls 74 and side walls 76 which are connected to the bottom 40 to form a closed chamber. A door 78 is hingeably connected to the bottom wall 72 to move in the direction indicated in FIG. 4 by the double-headed arrow 80. Opening the door 78 provides access to the compartment 70 so that fluid can be drained from that compartment or material such as a desiccant or a deodorizer or a germicide can be placed into that compartment. Such material is indicated in FIG. 4 as material 82.

The bottom 40 is arcuate and is shaped to be convex with respect to the top so it has a crown portion 84 near the center thereof, and so that it slopes towards the troughs. The bottom thus includes fore and a rear curved surfaces 86 and 88, and end curves surfaces 90 and 92 that are curved to conduct liquid to and into the troughs.

The mop head is squeezed against the curved bottom 40 by a mop squeezing means which includes projections 96 and 98 mounted on the inside of the top 52 to extend towards the bottom 40. The projections engage the top surface of the mop head and force such head against the bottom to squeeze the head between the projections and the bottom. This squeezing forces liquid out of the mop head, and such liquid is conducted by the curved bottom to the troughs. The liquid in the troughs flows to the drain holes and then into the compartment 70 to be absorbed, disinfected and deodorized.

The bottoms of the troughs are also sloped towards the drain holes as indicated by the shading in FIG. 3. The shading indicates a crown 98 in each trough that creates a slope from the center of the trough, at the crown, towards the drain holes. Thus, fluid moving into the troughs from the bottom will move towards the drain holes due to the sloping of the bottom and of the troughs.

To further ensure that the mop head is dried during storage, the container 10 has vent means that includes a plurality of vent passage groups 100 that are space apart from each other on the wall 30. Each vent passage group includes a plurality of vent openings 102 that are also spaced apart from each other so that air can pass freely into and out of the container even when the top is closed.

As indicated in FIGS. 2 and 4, the top side wall 44 and the bottom side wall 32 have semicircular cutouts 104 and 106, respectively, defined therein to co-operate with each other when the top is closed to form a hole 108 through which the mop handle 12 fits.

The container also includes a plurality of elongated strips 110 mounted on the front wall 32. The strips 110 are of deodorizing material and further ensure that the mop head is deodorized during storage in the container.

It is understood that while certain forms of the present invention have been illustrated and described herein, it is not to be limited to the specific forms or arrangements of parts described and shown.

I claim:

1. A container for a mop head comprising:

(A) a rectangular case bottom portion having first and second end walls, first and second side walls and a bottom connected to said end and side walls;

(B) a rectangular top portion having end walls, side walls and a top connected to said end and side walls;

(C) a hinge means pivotally connecting said top portion to said bottom portion;

(D) vent means on said first side wall of said bottom portion and including a plurality of vent passage groups, said vent passage groups being spaced apart from each other and each including a plurality of spaced-apart vent openings;

(E) a drainage system in said case bottom and including (1) two longitudinal troughs defined in said case bottom and extending beside said first and second side walls and from said first end wall to said second end wall, each longitudinal trough having a center section that is elevated with respect to the sections thereof to slope from said center section to said end sections, (2) two transverse troughs defined in said case bottom and extending beside said first and second end walls and from said first side wall to said second side wall and having a center section that is elevated with respect to the sections thereof to slope from said center section to said end sections, (3) drain holes in the end sections of said troughs, and (4) a fluid catching compartment mounted on the bottom to depend therebeneath, said fluid catching compartment including a bottom, side walls connected to said first and second side walls, end walls connected to said first and second end walls and a door hingedably connected to one of said compartment end walls, and (5) said drain holes fluidically connecting said troughs to said fluid catching compartment;

(F) said bottom being spherically shaped and curving to be convex with respect to said top and having a crown portion in the center and sloping continuously towards said longitudinal and transverse troughs;

(G) a desiccant and fluid deodorizing material in said fluid catching compartment;

(H) mop squeezing means on said top and including projections mounted on said top to extend toward said bottom when said top portion is in covering relation with said bottom portion, said projections being sized to contact a mop head which is located in said bottom portion and force such mop head against said bottom when said top portion is closed against said case bottom portion; and (I) lock means on said bottom and top portions to lock said top portion to said bottom portion.

2. The container defined in claim 1 further including a first semi-circular cutout defined in said first side wall and a second semicircular cutout defined in one of said top portion side walls to co-operate with said first output to form a circular hole when said top portion is in covering relation with said bottom portion.

3. The container defined in claim 2 further including a deodorizing material mounted on said first side wall.

4. The container defined in claim 3 wherein said deodorizing material is in the form of elongated strips which are spaced apart from each other.

5. The container defined in claim 4 wherein said strips are located between adjacent vent passage groups.

* * * * *